US008794438B2

(12) United States Patent
Copp et al.

(10) Patent No.: US 8,794,438 B2
(45) Date of Patent: Aug. 5, 2014

(54) ASSEMBLY WITH SHRINK BAG CONTAINER HAVING NON-SHRUNK INTEGRAL HANDLE

(75) Inventors: Timothy M. Copp, Danbury, CT (US); G. Taylor Richey, Hopewell Jct., NY (US)

(73) Assignee: Reelex Packaging Solutions, Inc., Patterson, NY (US)

( * ) Notice: Subject to any disclaimer, the term of this patent is extended or adjusted under 35 U.S.C. 154(b) by 70 days.

(21) Appl. No.: 13/506,545

(22) Filed: Apr. 27, 2012

(65) Prior Publication Data

US 2013/0284851 A1 Oct. 31, 2013

(51) Int. Cl.
*B65D 65/00* (2006.01)

(52) U.S. Cl.
USPC ..... 206/497; 206/409

(58) Field of Classification Search
USPC ..... 206/497, 409, 410, 466
See application file for complete search history.

(56) References Cited

U.S. PATENT DOCUMENTS

| | | | |
|---|---|---|---|
| 1,463,181 | A | 7/1923 | Vorderwinkler |
| 1,529,816 | A | 3/1925 | Stenglein |
| 2,388,557 | A | 11/1945 | Little et al. |
| 2,459,747 | A | 1/1949 | Kolbe |
| 2,634,918 | A | 4/1953 | Taylor et al. |
| 2,634,922 | A | 4/1953 | Taylor |
| 2,650,036 | A | 8/1953 | Berkepeis |
| 2,738,145 | A | 3/1956 | Taylor |
| 2,767,938 | A | 10/1956 | Taylor |
| 2,929,569 | A | 3/1960 | Detrick et al. |
| 2,943,732 | A | 7/1960 | Kovaleski et al. |
| 2,971,709 | A | 2/1961 | Ellis |
| 3,061,238 | A | 10/1962 | Taylor |
| 3,150,769 | A | 9/1964 | Cohn |
| 3,178,130 | A | 4/1965 | Taylor |
| 3,589,096 | A | 6/1971 | Podvin |
| 3,643,987 | A | 2/1972 | DuPont |
| 3,655,140 | A | 4/1972 | Gordon et al. |
| 3,666,200 | A | 5/1972 | Newman et al. |

(Continued)

FOREIGN PATENT DOCUMENTS

| | | |
|---|---|---|
| DE | 532861 | 9/1931 |
| GB | 2089761 | 6/1982 |
| JP | 2004217237 | 8/2004 |

OTHER PUBLICATIONS

U.S. Appl. No. 13/506,574; Timothy M. Copp et al, filed Apr. 30, 2012; Apparatus for Dividing Heat-Shrinkable Plastic Film into Different Temperature Regions.

(Continued)

*Primary Examiner* — David Fidei
(74) *Attorney, Agent, or Firm* — Gordon & Jacobson, PC

(57) ABSTRACT

A container/package of filamentary material wound in a coil and encased in heat shrinkable film with a payout tube extending through a payout hole in the container/package, the heat shrinkable film is formed as a pouch having an open end into which the coil is inserted; one end of the shrink wrap material is folded back on itself to form a hand-held cutout; the open end of the pouch is sealed and the shrunk wrap material is heated to seal the coil in the shrunk wrap material while isolating the hand-hold cutout; and the container/package is thus formed with a heat shrunk pouch tightly containing the coil of filamentary material and an attached portion not exposed to heat and not shrunk.

4 Claims, 1 Drawing Sheet

(56) References Cited

U.S. PATENT DOCUMENTS

| | | | | |
|---|---|---|---|---|
| 3,677,490 | A | 7/1972 | Gordon et al. | |
| 3,677,491 | A | 7/1972 | Gerwig | |
| 3,747,861 | A | 7/1973 | Wagner et al. | |
| 3,748,817 | A | 7/1973 | Newman | |
| 3,812,640 | A | 5/1974 | Knott | |
| 3,877,653 | A | 4/1975 | Foltyn et al. | |
| 3,923,270 | A | 12/1975 | Newman et al. | |
| 3,980,244 | A | 9/1976 | Pietroni | |
| 3,982,712 | A | 9/1976 | Bassett | |
| 3,985,315 | A | 10/1976 | Newman | |
| 4,009,845 | A | 3/1977 | Santucci et al. | |
| 4,019,636 | A | 4/1977 | Wise | |
| 4,022,399 | A | 5/1977 | Zajac | |
| 4,057,203 | A | 11/1977 | Newman et al. | |
| 4,057,204 | A | 11/1977 | Zajac | |
| 4,085,902 | A | 4/1978 | Wagner | |
| 4,098,467 | A | 7/1978 | Engmann et al. | |
| 4,160,533 | A | 7/1979 | Kotzur et al. | |
| 4,274,607 | A | 6/1981 | Priest | |
| 4,283,020 | A | 8/1981 | Bauer et al. | |
| 4,285,157 | A | 8/1981 | Lambert | |
| 4,313,579 | A | 2/1982 | Zuber et al. | |
| D267,394 | S | 12/1982 | Liptak et al. | |
| 4,367,853 | A | 1/1983 | Kotzur | |
| 4,373,687 | A | 2/1983 | Zicko | |
| 4,406,419 | A | 9/1983 | Kotzur | |
| 4,477,033 | A | 10/1984 | Kotzur et al. | |
| 4,523,723 | A | 6/1985 | Kotzur | |
| 4,535,587 | A | 8/1985 | Rias | |
| 4,555,025 | A * | 11/1985 | Weinberg et al. | 206/497 |
| D285,176 | S | 8/1986 | Kodousek et al. | |
| 4,637,564 | A | 1/1987 | Hallenbeck et al. | |
| 4,700,528 | A | 10/1987 | Bernard | |
| 4,792,100 | A | 12/1988 | Pepe | |
| 4,817,796 | A | 4/1989 | Camillo et al. | |
| 4,884,764 | A | 12/1989 | Hill | |
| 4,956,963 | A | 9/1990 | Johnson | |
| 5,042,739 | A | 8/1991 | Zajac | |
| 5,053,795 | A | 10/1991 | Wyman | |
| 5,115,995 | A | 5/1992 | Hunt | |
| 5,121,584 | A | 6/1992 | Suter | |
| 5,150,789 | A | 9/1992 | Bass | |
| 5,150,852 | A | 9/1992 | Hunt et al. | |
| 5,203,139 | A | 4/1993 | Salsburg et al. | |
| D341,777 | S | 11/1993 | Sheu | |
| D348,392 | S | 7/1994 | Tannen | |
| 5,368,245 | A | 11/1994 | Fore | |
| 5,470,026 | A | 11/1995 | Kotzur | |
| 5,499,775 | A | 3/1996 | Vander Groef | |
| 5,520,347 | A | 5/1996 | Bass et al. | |
| 5,529,186 | A | 6/1996 | Bass | |
| 5,593,035 | A | 1/1997 | Taylor et al. | |
| 5,624,528 | A | 4/1997 | Abrams et al. | |
| 5,678,778 | A | 10/1997 | Kotzur et al. | |
| 5,714,936 | A | 2/1998 | Regelsberger | |
| 5,740,659 | A | 4/1998 | Cox et al. | |
| D396,632 | S | 8/1998 | Lee | |
| 5,803,394 | A | 9/1998 | Kotzur et al. | |
| 5,810,272 | A | 9/1998 | Wallace et al. | |
| D400,096 | S | 10/1998 | Lee | |
| D406,753 | S | 3/1999 | Lee | |
| 5,938,260 | A | 8/1999 | Wallace et al. | |
| 5,941,050 | A | 8/1999 | Georgetti et al. | |
| 5,979,812 | A | 11/1999 | Kotzur et al. | |
| 6,003,667 | A | 12/1999 | Barnett et al. | |
| 6,086,012 | A | 7/2000 | Kotzur et al. | |
| 6,098,378 | A | 8/2000 | Wyatt | |
| 6,109,554 | A | 8/2000 | Kotzur et al. | |
| 6,145,722 | A | 11/2000 | Behrens et al. | |
| 6,276,623 | B1 | 8/2001 | Williams | |
| 6,341,741 | B1 | 1/2002 | Kotzur et al. | |
| 6,401,924 | B1 * | 6/2002 | Fresnel | 206/466 |
| 6,491,163 | B1 | 12/2002 | Grcic et al. | |
| 6,702,213 | B2 | 3/2004 | Kotzur et al. | |
| 6,766,627 | B2 | 7/2004 | Kotzur et al. | |
| 7,100,346 | B2 | 9/2006 | Kotzur et al. | |
| D541,145 | S | 4/2007 | Copp | |
| 7,249,726 | B2 | 7/2007 | Kotzur | |
| 7,469,520 | B2 | 12/2008 | Lancaster, III et al. | |
| 8,191,337 | B2 | 6/2012 | Moore | |
| 2002/0174626 | A1 | 11/2002 | Lancaster, III et al. | |
| 2006/0225385 | A1 | 10/2006 | Biba et al. | |
| 2007/0215505 | A1 | 9/2007 | Walker | |
| 2007/0272346 | A1 | 11/2007 | Shpik et al. | |
| 2008/0277523 | A1 | 11/2008 | Delmore | |

OTHER PUBLICATIONS

Proflex. Datasheet; (online) Reelex Packaging Solutions, Apr. 14, 2012, available at www.reelex.com/Packaging/ProFlex.html.

* cited by examiner

ASSEMBLY WITH SHRINK BAG CONTAINER HAVING NON-SHRUNK INTEGRAL HANDLE

BACKGROUND OF THE INVENTION

Field of the Invention

This invention relates to a container/package for retaining a coil of filamentary material and consisting of a bag or pouch made of heat-shrinkable film with one end folded back on itself and a hand-hold cutout formed on the container/packager. More specifically, the container/package consists of a coil of figure-eight filamentary material. A single sheet of heat-shrinkable material is positioned into a container section that has been shrunk around the coil and a handle or reinforced cutout section is isolated from the heat process forming the package. The cutout section is thus able to retain its original form as the shrink wrap material encases the coil.

The package or container design enables a single filamentary material to take on two distinct characteristics, namely: one of a heat shrunk container/package designed to tightly contain the loops or wraps of a figure-eight coil, and one of a handle that, if not isolated from the heat source which is encasing the wound coil in a heat-shrinkable material, would shrivel upon itself and thus not function as a hand-hold.

The end-user of the container/package of coil of filamentary material can use this container/package to dispense the coil through a payout tube attached to the side of the container/package through the shrunk wrap material.

SUMMARY OF THE INVENTION

The package/container of the invention retains a figure-eight coil of filamentary material and comprises a bag or pouch made of heat-shrinkable film in which one end is folded back on itself and a hand-hold cutout is made. The opposite end of the pouch is open so that a coil of filamentry material may be inserted. Once inserted, the open end of the pouch is sealed and heat is applied to the pouch of the package, thus shrinking the film around the coil.

The handle portion of the package is isolated from the heat and is prevented from shrinking, thus allowing the finished container/package/ to be a single sheet of material taking on the features of both a heat-shrunk pouch portion tightly containing a coil of filamentary material, and a attached handle portion which has not been exposed to heat and thus, is not shrunk.

BRIEF DESCRIPTION OF THE DRAWINGS

The above objects, features and advantages of the invention are readily apparent from the following description of a preferred embodiment of the best mode of carrying out the invention when take in conjunction with the following drawings, wherein.

DETAILED DESCRIPTION OF THE INVENTION

Figure 1:
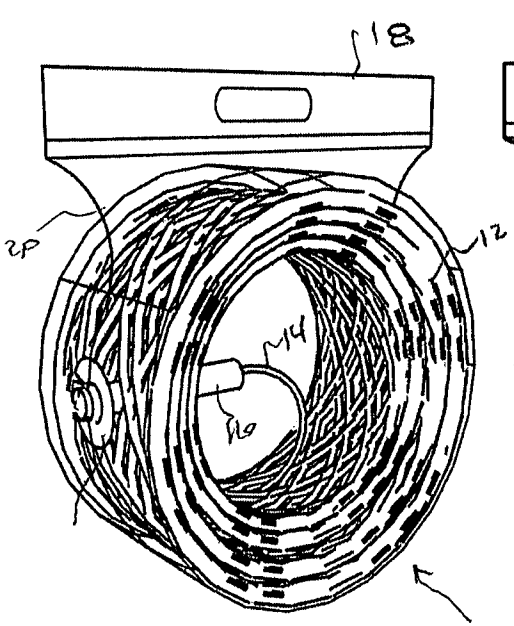
FIG. 1 is an isometric view of a specific application of the invention to a coil of filamentary material wound in a figure-eight configuration and wrapped in a heat shrinkable material with an inner end of the coil inserted in a payout tube extending from the inner wind of the coil to the outer wind of the coil and the manner of forming a hand-hold on the wound coil.

The isometric view of the unfinished container/package 10 wrapped in a heat shrinkable material in the isometric view of FIG. 1 shows the coil of filamentary material wound in a figure-eight configuration 12 with an inner end of the coil 14 inserted in a payout tube 16 extending from the inner wind of the coil through a payout hole in the side of the wound coil (not shown) to the outer wind of the coil. A hand-hold is formed on the wound coil.

With continuing reference to FIG. 1, hand-hold 18 is formed as a bag or pouch made of heat-shrinkable film within which the coil of filamentary material 12 is formed. One end of the heat shrinkable film is folded back on itself to form a hand-hold cutout 20. The coil of filamentary material 12 is inserted in the pouch 20. Once the coil is inserted in the pouch 20, the open end of the pouch is sealed and heat is applied to the pouch portion of the package, thereby shrinking the film around the coil. The handle portion 18 of the container/package is isolated from the heat and is thereby prevented from shrinking. The completed package/container can be described as a single sheet of material having both the features of a heat-shrunk pouch portion tightly containing a coil of filamentary material, and an attached handle portion which has not been exposed to heat and thus, not shrunk.

Figure 2:
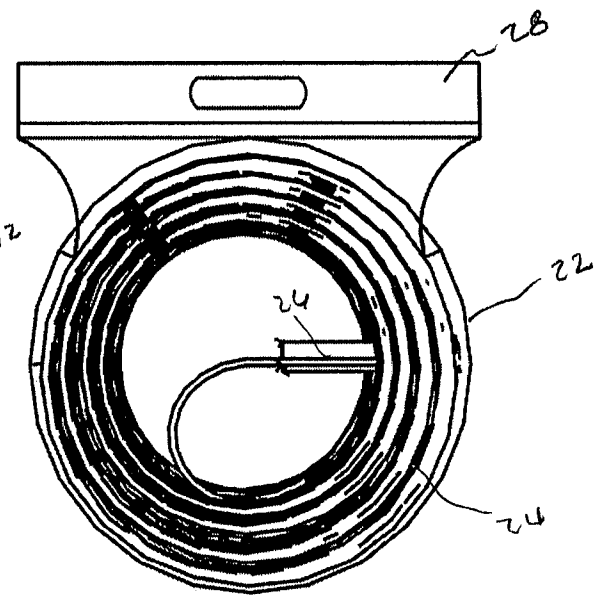
FIG. 2 is a front view of the finished container/package wrapped in a heat shrinkable material and showing the inner end of the coil of filamentary material wound in a figure-eight configuration and inserted in the payout tube inserted in the payout hole of the coli with the hand-hold attached to the coil.

FIG. 2 is a front view of the finished container/package 22 wrapped in a heat shrinkable material and showing the inner end of the coil (not shown) of filamentary material 24 wound in a figure-eight configuration and inserted in the payout tube which is inserted in the payout hole (not shown) of the coil with the hand-hold 28 attached to the coil.

It is to be understood that the invention has broader application than to just coils of filamentary material wound in a figure-eight configuration, such as the well known REELEX coil. For example, the invention has application to all types of wound coils of filamentary material whether in the figure eight REELEX configuration or not. Moreover, it is apparent that the invention has application to any type of material wound in a coli and that is capable of having handle formed on the periphery of the coil.

The invention claimed is:

1. An assembly, comprising:

a) a coil of wound filamentary material defining an annulus having a first axis and a payout hole extending through the wound filamentary material having a second axis substantially perpendicular to said first axis;

b) a payout tube extending into said payout hole; and c) a heat shrinkable film having a first portion formed as a heat-shrunk pouch tightly containing said coil of filamentary material and said payout tube, and a second portion integral with said first portion and formed as a non-shrunk hand-hold portion, said second portion defining a handle opening adapted for receiving a human hand, wherein said first portion, prior to being heat-shrunk, is formed as a pouch having an open end into which said coil is inserted, said open end being located opposite said hand-hold portion.

2. An assembly according to claim 1, wherein:

said non-shrunk hand-hold portion is substantially parallel to said second axis, and said handle opening defined in said second portion extends through said second portion in a direction substantially parallel to said annulus.

3. An assembly according to claim 1, wherein:

an end of said second portion opposite said open end of said pouch is folded back on itself

4. An assembly according to claim 2, wherein:

an end of said second portion opposite said open end of said pouch is folded back on itself.

* * * * *